United States Patent [19]

Rogers

[11] Patent Number: 4,690,440

[45] Date of Patent: Sep. 1, 1987

[54] STRENGTHENED LATCH AND STRIKER BAR STRUCTURE FOR FENCE GATES

[76] Inventor: Gerald H. Rogers, Rte. 1, Athens, Tex. 75751

[21] Appl. No.: 814,312

[22] Filed: Dec. 30, 1985

[51] Int. Cl.[4] ..... E05C 3/14

[52] U.S. Cl. ..... 292/54; 292/205; 292/228

[58] Field of Search ..... 292/230, 219, 121, 130, 292/136, 24, 31, 228, 128, 44, 54, 26, 48, 205

[56] References Cited

U.S. PATENT DOCUMENTS

| | | | |
|---|---|---|---|
| 61,604 | 1/1867 | Broomhall | 292/54 |
| 87,065 | 2/1869 | Redhead | 292/136 |
| 284,743 | 9/1883 | Kroedel et al. | 292/130 |
| 497,863 | 5/1893 | Christian | 292/24 |
| 559,296 | 4/1896 | Lewis | 292/26 |
| 774,428 | 11/1904 | Hopp | 292/54 |
| 797,485 | 8/1905 | Zanders | 292/128 |
| 844,907 | 2/1907 | Aikin | 292/136 |
| 960,777 | 6/1910 | Barnwell | 292/121 |
| 991,119 | 5/1911 | Warns | 292/31 |
| 1,082,408 | 12/1913 | Conrad | 292/128 |
| 1,204,228 | 11/1916 | Zanders | 292/128 |
| 1,326,554 | 12/1919 | Watson | 292/44 |
| 1,360,040 | 11/1920 | Slauson | 292/54 |
| 1,789,619 | 1/1931 | Doddy, Jr. | 292/230 |
| 1,830,786 | 11/1931 | Ferris | 292/136 |
| 1,929,479 | 10/1933 | Campbell | 292/44 |
| 2,166,499 | 7/1939 | Lange | 292/128 |
| 4,451,072 | 5/1984 | Petty, Sr. | 292/31 |

FOREIGN PATENT DOCUMENTS

| | | | |
|---|---|---|---|
| 846584 | 8/1960 | United Kingdom | 292/130 |

*Primary Examiner*—William F. Pate, III
*Assistant Examiner*—Michael Safavi
*Attorney, Agent, or Firm*—Warren H. Kintzinger

[57] ABSTRACT

A gate latch structure with a striker bar is mounted on a fence gate hinge mounted to the fence. A gate handle is provided that has a striker bar enclosing loop reinforcing the mounting of the striker bar on the gate. The latch structure also includes a pivotal latch member pivotally mounted on a latch mounting back plate that is mountable on a fence post or the middle end of the other half of a double gate. The striker bar receiving opening in the pivotal latch member has a rear edge recessed back from the rear end of the striker bar receiving opening in the latch mounting back plate. With this structure the back plate absorbs striker bar closing impact directly rather than such impact being imposed on the pivotal latch member and on the pivot screw mounting the pivotal latch member.

16 Claims, 7 Drawing Figures

STRENGTHENED LATCH AND STRIKER BAR STRUCTURE FOR FENCE GATES

Figure 1:
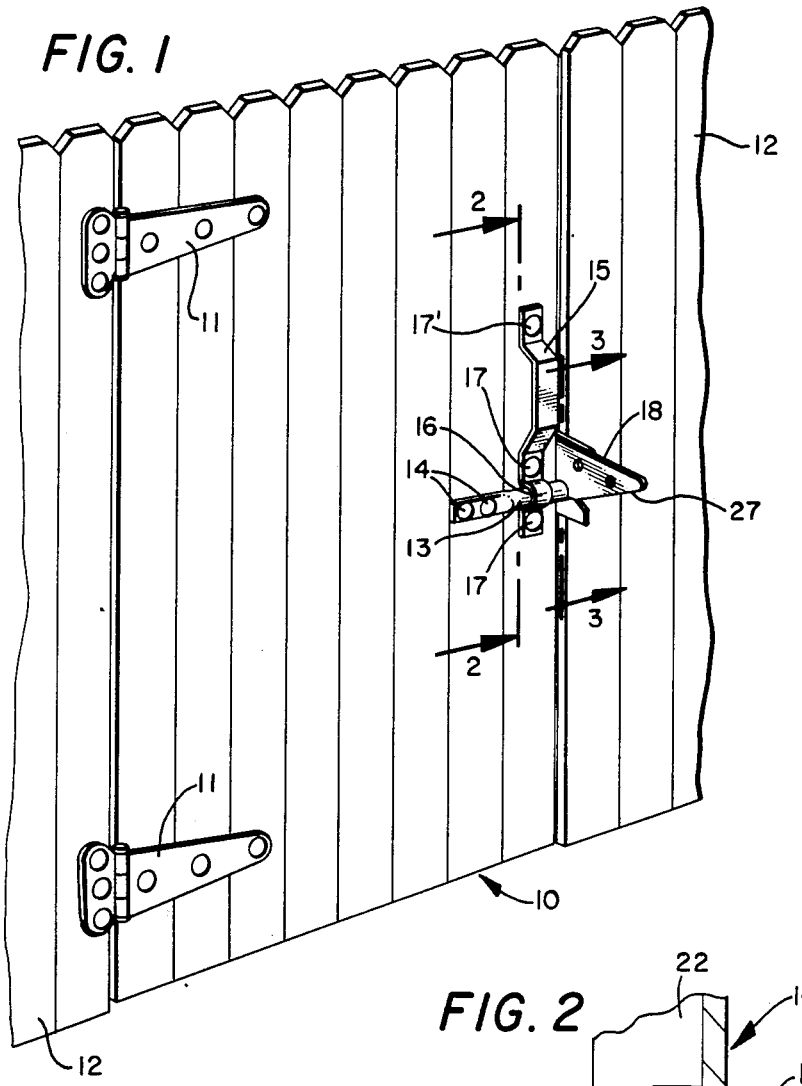

This invention relates in general to fence gates and gate latches, and more particularly, to a strengthened gate latch and striker bar structure useable on single gates and double gates.

Many existing gate latches are constructed in such a manner that the striker bar impacts on the back side of the striker bar opening in the pivotal latch member as a gate latch is closed. This imposes great impact shock loads on the pivotal latch member itself and on the pivot screw mounting the pivot latch member. With repeated cycles of this impact shock loading the mounting of the pivot latch member tends to become loosened, and many times the pivot mounting is severed. With the gage latch structure loosened the gate can work back and forth in a wind imposing further destructive stress on the gate and gate latch structure. Further, proper alignment between the adjacent ends of a double gate or of a tall gate with the fence of the opening and closing end of the gate can be important in preventing further wind load working of the gate.

It is therefore a principal object of this invention to provide a strengthened gate latch and striker bar structure for fence gates.

Another object is to eliminate striker bar impact loading from the pivotal latch member and the pivot screw mounting the pivotal latch member.

A further object is to provide a smooth acting positive action gate latch constructed for long life reliable service.

Still another object is to provide such a gate latch with minimal if any maintanence repair requirements.

Features of the invention useful in accomplishing the above objects include, in a strengthened gate latch and striker bar structure for fence gates a gate latch striker bar and gate handle mounted on a fence gate hinge mounted to a fence. The gate handle has a striker bar enclosing loop extension reinforcing the mounting of the striker bar on the gate. The latch structure also includes a pivotal latch member pivotally mounted on a latch mounting back plate that is mountable on a fence post or the middle end of the other half of a double gate. The striker bar receiving opening in the pivotal latch member has a rear edge recessed back from the rear end of the striker bar receiving opening in the latch mounting back plate. With this structure the back plate absorbs striker bar closing impact directly rather than such impact being imposed on the pivotal latch member and on the pivot screw mounting the pivotal latch member. Proper alignment between adjacent ends of a double gate or of a tall gate with the fence at the opening and closing end of the gate is enhanced through use of two vertically spaced gate latch and striker bar structures with the outer ends of the pivotal latch members interconnected by a latch lift bar.

Specific embodiments representing what are presently regarded as the best modes of carrying out the invention are illustrated in the accompanying drawings.

Figure 2:
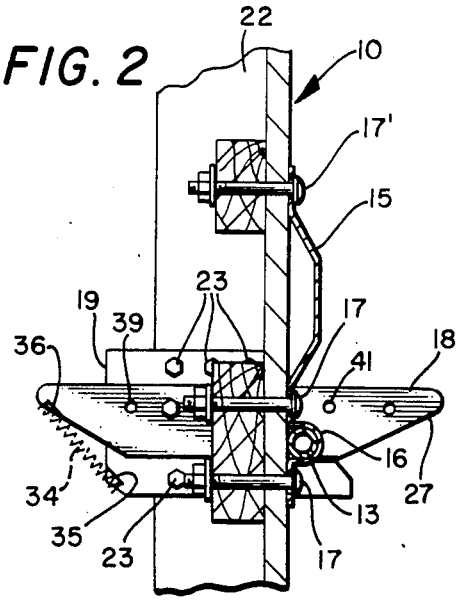
Figure 7:
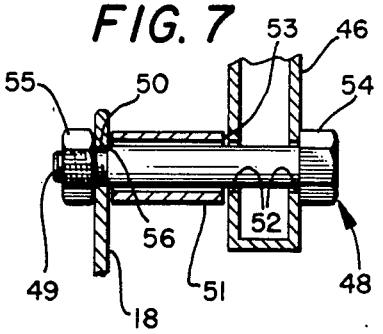
Figure 3:
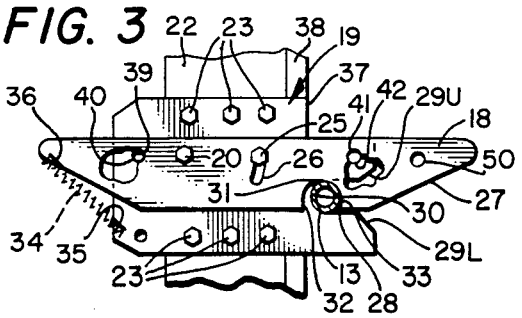
Figure 6:
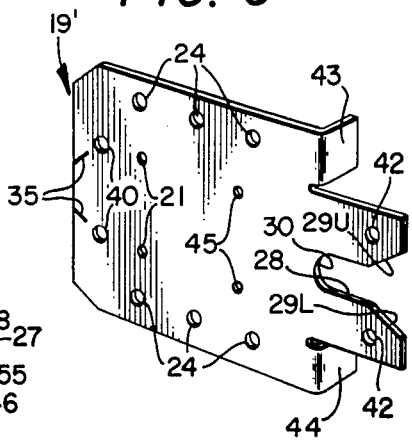
Figure 5:
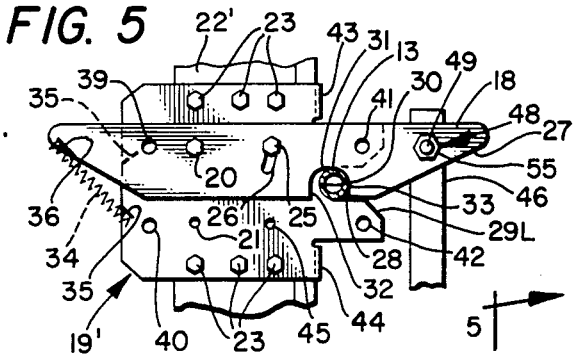
Figure 4:
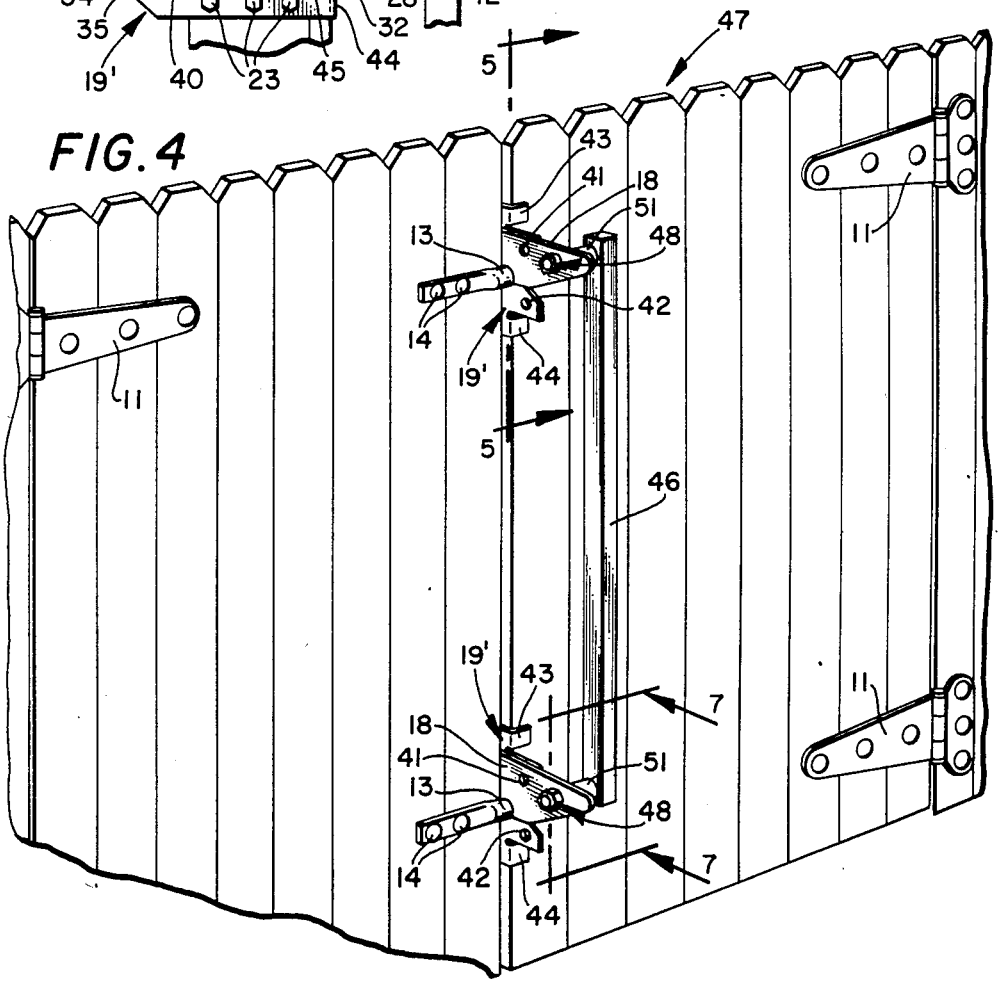

In the drawings:

FIG. 1 represents a perspective view of a pivot hinge mounted fence single gate equipped with a strengthened latch and striker bar structure;

FIG. 2, a partially cut away and sectioned view taken along line 2—2 of FIG. 1 showing detail of the striker bar and latch structure and of the gate handle with a stiker bar enclosing loop extension;

FIG. 3, a partially cut away and sectioned enlarged view taken along line 3—3 of FIG. 1 showing more latch and striker bar detail;

FIG. 4, a perspective view of a double fence gate using two vertically spaced gate latch and striker bar structures with the outer ends of pivotal latch members interconnected by a latch lift bar;

FIG. 5, an enlarged partially cut away and sectioned view taken along line 5—5 of FIG. 4 showing gate latch detail of another embodiment with a different latch mounting back plate than with the gate latch embodiment of FIGS. 1-3;

FIG. 6, a perspective view of the gate latch mounting back plate of FIGS. 4 and 5; and FIG. 7, a partial cut away and sectioned enlarged view taken along line 7—7 of FIG. 4 showing detail of the mounting of the pivotal latch member interconnect latch lift bar.

Referring to the drawings:

A gate 10 pivotally mounted by tee hinges 11 in fence 12 is shown in FIG. 1 to be provided with a gate latch striker bar 13 mounted on the gate 10 by bolts 14. Referring also to FIG. 2 gate handle 15 is shown to have a striker bar enclosing extension loop 16 with mounting bolts 17 on opposite sides thereof and an additional bolt 17' at the other end of the handle 15 extended through the gate. This handle extension loop 16 along with bolts 17 reinforces the mounting of the striker bar 13 on the gate 10. The striker bar 13 is made from tubing with a portion, that bolts 14 extend through, flattened, and the striker bar extension thereof passes under handle loop 16 and on out to engage the pivotal latch member 18 and back plate 19.

Referring also to FIG. 3 the pivotal latch member 18 is pivotally mounted on the face of gate latch mounting back plate 19 by pivot screw 20 that extends through an opening 21 in plate 19 on into a fence post 22 (or a latch mounting block 22' on the back of the other half of a double gate such as shown in FIG. 5). The gate latch mounting back plate 19 is mounted by screws 23 that extend through openings such as openings 24 in the back plate 19' embodiment of FIGS. 4, 5 and 6 on into a fence post 22 or a latch mounting block 22'. Pivot latch member 18 is limited in pivotal movement about pivot screw 20 by limit screw 25 engaging opposite ends of arcuate slot 26 in the pivot latch member 18 with the range of pivotal movement thereof adequate for the latching action required. The striker bar 13 engages pivot latch member 18 entrance cam surface 27 to pivot the pivot latch member 18 upward as the striker bar 13 enters the striker bar receiving opening 28 in the latch mounting back plate 19. The striker bar receiving opening 28 has two entrance cam surfaces 29L and 28U that aid in insuring proper gate alignment and mutual support as the gate is drawn to the closed and latched state. As the gate is drawn to the closed state striker bar 13 comes into contact with the rear end 30 of the striker bar receiving opening 28 with the back plate absorbing striker bar closing impact directly rather that such impact being imposed on the pivotal latch member and on the pivot screw mounting the pivot latch member. This interaction of the gate latch also supports weight of the gate and aids in minimizing gate sag. The pivotal latch member 18 has a downward facing opening 31 having a rear edge 32 recessed back from the rear end 30 of the striker bar receiving opening 28 such that the back plate 19 (19') absorbs striker bar 13 gate closing impact directly rather than such impact being imposed on the pivotal latch member 18 and on the pivot screw 20 mounting the pivotal latch member 18. The opening 31 is so sized that the extension of striker bar 13 is contained therein in the latched state behind the forward edge 33 of the opening 31 and in opening 28 with the pivotal latch member 18 having dropped to the latched state. The pivotal latching action can be enhanced by use of a compression spring 34 mounted with one end in slot 35 of back plate 19 and the other end in slot 36 of the pivotal latch member 18. It should be noted, however, that the latch structure performs its latching function generally quite well without such a compression spring 34.

The gate latch mounting back plate 19 is mounted with front edge 37 and the rear end 30 of opening 28 in general alignment with the front face 38 of the fence portion mounting the back plate 19. A padlock bar hole 39 is provided in the rear of pivotal latch member 18 that aligns with back plate opening 40 for padlocking the gate from the back, and in like manner a padlock bar hole 41 is provided in the front of pivotal latch member 18 that aligns with back plate opening 42 for padlocking the gate from the front.

The gate latch mounting back plate 19' of FIGS. 4, 5 and 6 is a generally symetrical unit, with indexing flanges 43 and 44, that may be flipped over for mounting on one gate side or the other and still mount pivotal latch member 18 in substantially the identical manner only from the reverse side. This permits mounting the gate latch hardware for left hand opening gates and alternately for right hand opening gates with indexing to the front face of the fence portion mounting the back plate 19'. The plate 19' is provided with two taped holes 45 one or the other of which is used for the limit screw 25 depending on which way the plate 19' is flipped. Further, plate 19' is provided with two bolt holes 21, two padlock openings 42, and two padlock openings 40, and with two slots 35 to accomodate the plate 19' being flipped one way or the other.

While a single latch structure may be used particularly with a single gate as shown in FIG. 1 two latch structures may be used as shown in FIGS. 4, 5 and 7 with the outer ends of the pivotal latch members 18 interconnected by a latch lift bar 46 that functions as a handle for the double gate 47. Proper alignment between adjacent ends of a double gate 47 or of a tall gate with the fence at the opening and closing end of the gate is enhanced through use of two vertically spaced gate latch and striker bar structures with the outer ends of the pivotal latch members 18 interconnected by a latch lift bar 46.

Referring also to FIG. 7 the latch lift bar 46 is mounted on the outer ends of pivotal latch members 18 with bolt assemblies 48 having a threaded end 49 extended through openings 50 and with tubular spacer 51 positioning the latch lift bar 46 pivotally with openings 52 therethrough between the spacer outer ends 53 and bolt heads 54. Nuts 55 tightens the latch members 18 against the shoulders 56 of the bolt assemblies 48.

Whereas this invention has been described with respect to several embodiments thereof, it should be realized that various changes may be made without departure from the essential contributions to the art made by the teachings hereof.

I claim:

1. A gate latch and striker bar structure comprising: latch striker bar means with a striker bar extension mountable on a pivotally mounted gate panel pivotal into open and closed states; a gate latch with a latch mounting back plate mountable on a fence gate member and having a striker bar receiving opening with a rear end that absorbs striker bar closing impact directly with closing of said gate panel; a pivotal latch member pivotally mounted on said latch mounting back plate for pivotal movement up and down; pivotal mounting means pivotally mounting said pivotal latch member on said latch mounting back plate; pivotal latch member pivot position limiting means mounted on said latch mounting back plate; cam surface means on said pivotal latch member engageable by said latch striker bar to lift said pivotal latch member as said gate panel is being moved to the closed state after which the pivotal latch member drops down to a latched state with the gate panel in the closed state; a downward facing opening enclosing said striker bar extension in the latched state in said pivotal latch member having a rear edge recessed back from the rear end of said striker bar receiving opening to prevent contact of said rear edge with said latch striker bar as said gate panel is being pivoted to the closed state insuring that the back plate absorbs striker bar closing impact directly rather than such impact being imposed on the pivotal latch member and on said pivotal mounting means; and wherein said pivotal mounting means is a pivot screw extended through a pivot opening in said pivotal latch member, and threaded into a threaded opening in said latch mounting back plate; and wherein said pivotal latch member pivot position limiting means includes, a limit screw threaded into a threaded opening in said latch mounting back plate; and a slot in said pivot latch member with opposite slot ends coming into engagement with said limit screw to limit pivotal movement of said pivot latch member about said pivot screw.

2. The gate latch and striker bar structure of claim 6, wherein a gate handle is provided having a striker bar enclosing loop mountable on said pivotally mounted gate panel to reinforce the striker bar on the gate panel.

3. The gate latch and striker bar structure of claim 2, wherein said striker bar is formed with a flattened mounting portion through which mounting bolt means extend, and with a round striker bar extension that passes under said gate handle striker bar loop and on out to engage said pivotal latch member and said latch mounting back plate as said gate panel is being pivoted to the closed state.

4. The gate latch and striker bar structure of claim 3, wherein said striker bar is formed from metal tubing with said mounting bolt means a plurality of bolts extended through said flattened mounting portion; and said gate handle is a stamped metal strap including said striker bar enclosing loop with bolts extended through said gate handle stamped metal strap on opposite sides of said striker bar loop and at an end of the handle strap remote from said striker bar loop.

5. The gate latch and striker bar structure of claim 1 wherein sad fence gate member has a front face; said latch mounting back plate has position indexing means for mounting the latch mounting back plate on said fence gate member with the rear end of said striker bar receiving opening in general alignment with said front face of said fence gate member mounting the back plate.

6. The gate latch and striker bar structure of claim 5, wherein said latch mounting back plate position indexing means is a forward facing edge of said latch mounting back plate.

7. The gate latch and striker bar structure of claim 5, wherein said latch mounting back plate position indexing means is indexing flange means that overlies the front face of the fence gate member mounting the back plate.

8. The gate latch and striker bar structure of claim 5, wherein said latch mounting back plate and said pivotal latch member both project forwardly beyond said latch mounting back plate position indexing means and are each equipped with padlock bar holes in the forwardly projecting portions that are in alignment when said pivotal latch member is in the latched state position.

9. The gate latch and striker bar structure of claim 8, wherein said latch mounting back plate and said pivotal latch member both project rearwardly to the rear of said fence gate member the latch mounting back plate is mounted on and are each equipped with padlock bar holes in the rearwardly projecting portions that are in alignment when said pivotal latch member is in the latched state position.

10. The gate latch and striker bar structure of claim 5, wherein said latch mounting back plate and said pivotal latch member both project rearwardly beyond the rear of the fence gate member the latch mounting back plate is mounted on and are each equipped with padlock bar holes in the rearwardly projecting portions that are in alignment when said pivotal latch member is in the latched state position.

11. The gate latch and striker bar structure of claim 5, wherein said pivotal latch member projects forwardly beyond the forward projection of said latch mounting back plate and is provided with an outer end opening.

12. The gate latch and striker bar structure of claim 11, wherein two vertically spaced gate latch and striker bar structures are mounted in a gate structure with said pivotal latch members interconnected by a latch lift bar with connective means to each of said outer end openings from opposite ends of said latch lift bar.

13. The gate latch and striker bar structure of claim 12, wherein said fence gate member is an additional pivotally mounted gate member, of a double gate system, opposite to said pivotally mounted gate panel.

14. The gate latch and striker bar structure of claim 5, wherein said pivotal latch member is provided with a spring end receiving slot; said latch mounting back plate is provided with a spring end receiving slot; with said spring end receiving slots in rearwardly projecting portions of said pivotal latch member and said back plate; and a compression spring mounted with opposite ends in said spring end receiving slots to provide a faster sharper latching action as the pivotally mounted gate panel is closed.

15. The gate latch and striker bar structure of claim 7, wherein said latch mounting back plate is a symetrical unit with two indexing flanges that may be flipped over for mounting on one gate side or the other and still mount said pivotal latch member from a pivotal mounting screw threaded opening for the specific flipped over state being used.

16. The gate latch and striker bar structure of claim 1, wherein the striker bar receiving opening in said latch mounting back plate is provided with upper and lower divergent entrance cam surfaces that guide entrance of the striker bar into the striker bar receiving opening with closing movement of said pivotally mounted gate panel and aid in insuring proper gate alignment and mutual support as the gate is drawn to the closed and latched state.

* * * * *